US005611279A

United States Patent [19]

Ando et al.

[11] Patent Number: 5,611,279

[45] Date of Patent: Mar. 18, 1997

[54] PROCESS OF PRODUCING A PRINTING PLATE FOR A STAMP

[75] Inventors: Yoichi Ando; Fumitoshi Nakamura, both of Sagamihara; Haruhito Shiraishi, Yokohama; Hajime Toda, Machida; Susumu Suzuki, Fujioka; Koichi Hirano, Yokohama; Hisami Tamano, Machida, all of Japan

[73] Assignee: Mitsubishi Pencil Kabushiki Kaisha, Tokyo, Japan

[21] Appl. No.: 454,252

[22] PCT Filed: Sep. 30, 1994

[86] PCT No.: PCT/JP94/01640

§ 371 Date: Jun. 2, 1995

§ 102(e) Date: Jun. 2, 1995

[87] PCT Pub. No.: WO94/01640

PCT Pub. Date: Sep. 30, 1994

[30] Foreign Application Priority Data

| | | | |
|---|---|---|---|
| Oct. 2, 1993 | [JP] | Japan | 5-269685 |
| Dec. 28, 1993 | [JP] | Japan | 5-350719 |
| Feb. 18, 1994 | [JP] | Japan | 6-021467 |
| Jun. 27, 1994 | [JP] | Japan | 6-145031 |

[51] Int. Cl.[6] ..... B41K 1/50

[52] U.S. Cl. ..... 101/401.1; 101/333

[58] Field of Search ..... 101/103, 327, 101/328, 333, 368, 379, 401, 401.1, 405, 406

[56] References Cited

U.S. PATENT DOCUMENTS

| | | | |
|---|---|---|---|
| 5,392,711 | 2/1995 | Kainuma | 101/401.1 |

FOREIGN PATENT DOCUMENTS

| | | | |
|---|---|---|---|
| 1421425 | 10/1968 | Germany | 101/401.1 |
| 49-7003 | 1/1974 | Japan . | |
| 50-155323 | 12/1975 | Japan . | |
| 51-95469 | 8/1976 | Japan . | |
| 52-71710 | 11/1977 | Japan . | |
| 17414 | 2/1978 | Japan | 101/401.1 |
| 57-136652 | 8/1982 | Japan . | |
| 60-193686 | 10/1985 | Japan . | |
| 61-56071 | 4/1986 | Japan . | |
| 166537 | 7/1988 | Japan | 101/401.1 |
| 3-96383 | 4/1991 | Japan . | |

*Primary Examiner*—Stephen R. Funk
*Attorney, Agent, or Firm*—Darby & Darby

[57] ABSTRACT

A stamp and a process of producing a stamp includes a stamp that is made from a sponge having open cells to allow repeated impressing operations without supplying stamp ink for a long time. The process includes fitting a heat-fusing ink sheet or a heat-generating plate, which contains a heat-generating material, over the surface of a stamp-piece that has open cells therein. A liquid substance soaks a manuscript having characters, patterns, etc., which are represented by non-applied areas of recording material. The manuscript is placed over the top in such a manner that an image may appear to be a mirror image. The manuscript is irradiated from above with light to cause light to pass through the non-applied areas of recording material to increase the temperature of the heat-generating material at sites corresponding to the non-applied areas of recording material. The generated heat of the heat-generating material corresponding to the non-applied portion of recording material fuses that part of the surface of the stamp-piece, thereby forming non-oozing areas of stamp ink while the stamp surface portion corresponding to the applied areas of recording material is not fused, thus forming oozing areas of stamp ink.

22 Claims, 8 Drawing Sheets

Fig. 1a
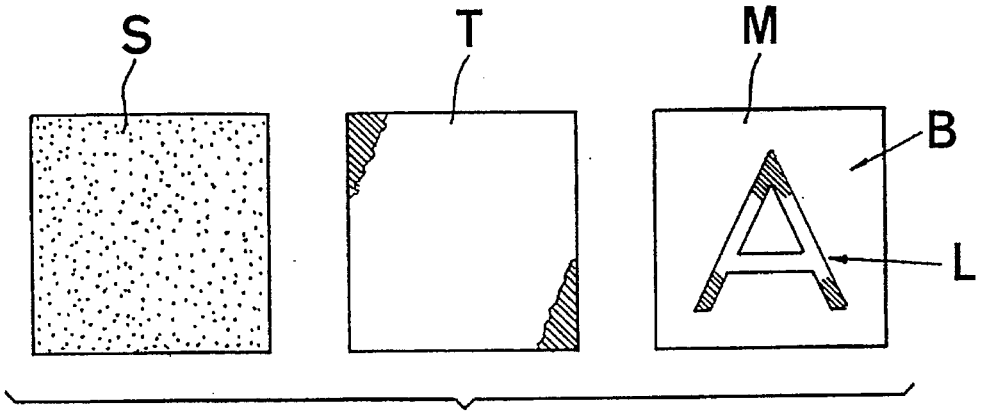
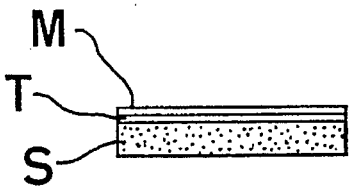
Fig. 1b
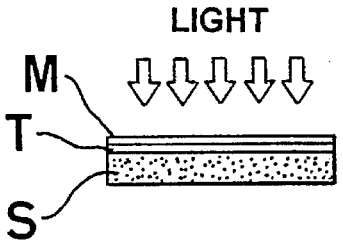
Fig. 1c
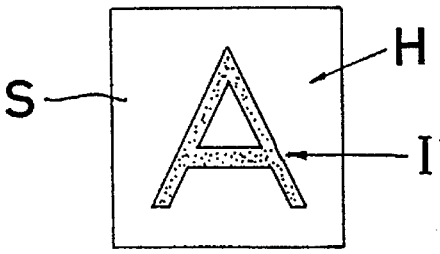
Fig. 1d

PROCESS OF PRODUCING A PRINTING PLATE FOR A STAMP

TECHNICAL FIELD

The present invention relates to a process of producing a printing plate for a stamp. More specifically, the present invention relates to a stamp as well as to a process of producing a printing plate for a stamp which is made of a sponge having open cells and absorbs stamp ink so as to be able to make repeated impressing operations without supplying stamp ink for a long time.

BACKGROUND ART

In order to save time and labor for applying stamp ink on a stamping surface every time a stamp or stamping plate is impressed, a stamp has been known which has a stamping material made of a rubber sponge having open cells and allows the material to previously occlude ink. For producing the stamp, a producing process of the stamp is disclosed in Japanese patent Application Laid-Open Sho 60 No.193686 in which other part than the impress image forming portion on the sponge surface is pressed and cured to in concave state by hot emboss-forming, so that the convex portion of the sponge may serve as an ink occluding portion for producing the impress image forming portion. Japanese Patent Application Laid-Open Sho-50 No.155434 also discloses a method in which a porous material is pressed against a similar heated plate. These methods, however, require a mold for the heated plate and time and labor for engraving or etching characters, signs, patterns etc. on the die.

Japanese Patent Application Laid-Open Sho-57 No.136652 as well as Japanese Patent Application Laid-Open Sho-49 No.7003, disclose a method of producing a printing plate comprising the steps of: applying a photopolymeric liquid resin on the surface of a stamp-piece made of sponge; placing a positive sheet over the top of the stamp-piece; irradiating the stamp-piece from above with ultraviolet rays to cause a photopolymeric reaction; and washing out the unconverted resin. A similar method using a film negative is disclosed in Japanese Utility Model Application Laid-Open Sho-52 No.71710. Each of these methods, however, has a drawback, such as, for example indulges complicated steps such as preparing a film negative or positive, application of resin, photopolymerization, rinsing and so on. Also, a reference to preparation of a printing surface using a stamp-piece made of sponge is written in Japanese Patent Application Laid-Open Hei 3 No.96383. Further, Japanese Utility Model Application Laid-Open Sho-50 No.41620 shows a method of preparing an original by decomposing a manuscript material with a screen in order to create a stamp of a photograph or a design having gradations in tone.

SUMMARY OF THE INVENTION (Summary of the Invention)

It is an object of the present invention to solve the above problems and provide a process of producing a printing plate for a stamp having open cells therein, based on a simple manufacturing process using simple devices. Another object of the present invention is to provide a printing plate for a stamp which has open cells and is capable of producing a clear impression. Still another object of the present invention is to provide a process of producing a printing plate for a halftoned stamp having open cells whereby photographs and designs having gradations in tone can be easily formed into a halftoned stamp.

In order to attain the above objects, the present inventors earnestly studied and found a process of producing a printing plate for a stamp wherein oozing areas of stamp ink and non-oozing areas of stamp ink are created by placing a manuscript over a stamp-piece having open cells with a heat-generating plate interposed therebetween and irradiating the manuscript with a radiation of light beams. The present innovators further developed on the basis of the above method, a producing process without using any heat-generating plate, a producing process of a printing plate for a stamp wherein a manuscript is immersed in a liquid substance so that the light-transmittance through the manuscript is improved, and a producing process of a printing plate for a stamp of a design having gradations in tone by using a screen-like heat-generating plate, and thus completed stamps using these methods.

A first producing process of a printing plate for a stamp of the present invention, comprises the steps of:

fitting a manuscript having characters, patterns and the like displayed by applied areas of recording material and non-applied areas of recording material, over a stamp-piece made of an elastic resin having open cells therein and capable of absorbing stamp ink, with a heat-generating plate containing a heat-generating material which will be elevated in temperature when exposed to light, interposed between the manuscript and the stamp-piece;

irradiating the manuscript with light so as to cause light passing through the non-applied areas of recording material to increase the temperature of the heat-generating material at corresponding sites to the non-applied areas of recording material whereby the surface part of the stamp-piece at corresponding sites to the temperature-elevated portions of the heat-generating material is fused with the heat to confine pores, forming non-oozing areas of stamp ink; and causing the applied areas of recording material to block light so as to inhibit temperature rise of the heat-generating material in corresponding places to the applied areas of recording material, whereby open cells are maintained to be open in the corresponding surface part of the stamp-piece to the temperature-rise inhibited portions in the heat-generating material, forming oozing areas of stamp ink.

The following features are preferable for the first producing process.

A variety of the manuscript having characters, patterns and the like displayed by applied areas of recording material and non-applied areas of recording material, includes one in which an image portion with characters, patterns etc. (impress original image) is represented by applied areas of recording material, one in which an image portion with characters, patterns etc., is represented by non-applied areas of recording material, and a design having light and dark tones displayed by variations in dot density of the non-applied areas of recording material or the applied areas of recording material.

The heat-generating plate containing a heat-generating material which will be elevated in temperature when exposed to light is preferably a sheet-like material consisting of a heat-generating material containing carbon or high molecular substances, or a sheet-like material comprising: a sheet or the like allowing infrared rays to pass therethrough; and a heat-generating material consisting of ink or toner containing at least one material selected from the group consisting of carbon and high molecular substances, applied on at least one side of the sheet or the like. Another preferable heat-generating plate is a sheet-like material comprising: a sheet or the like allowing infrared rays to pass therethrough; and a heat-generating material consisting of a heat-fusing material having a higher melting point than a fusing temperature of the stamp-piece and containing at least one material selected from the group consisting of carbon and high molecular substances, applied on the whole face of one side of the sheet or the like. The higher melting point than a fusing temperature of the stamp-piece is typically from about 60° to 150° C.

When a printing plate for a stamp having a design etc., representing light and dark tones is to be produced, it is preferable that a design having light and dark tones represented by variations in dot density is used as a manuscript while the heat-generating plate uses a sheet-like material comprising: a sheet or the like allowing infrared rays to pass therethrough; a heat-generating material containing at least one material selected from the group consisting of carbon and high molecular substance, applied in a dotted pattern on the sheet or the like. More preferably, the heat-generating plate is a sheet-like material comprising: a sheet or the like allowing infrared rays to pass therethrough; and a heat-generating material consisting of a heat-fusing material having a higher melting point than a fusing temperature of the stamp-piece and containing at least one material selected from the group consisting of carbon and high molecular substances, applied in a dotted pattern on the sheet or the like.

A second producing process of a printing plate for a stamp of the present invention, comprises the steps of:

fitting a manuscript using a recording material of a heat-generating material which will be elevated in temperature when exposed to light, over a stamp-piece made of an elastic resin having open cells therein and capable of absorbing stamp ink, irradiating the manuscript with light so as to increase the temperature of applied areas of heat-generating material whereby the surface of the stamp-piece at corresponding sites to the temperature-elevated areas of the heat-generating material is fused with the heat to create fused portions confining pores, forming non-oozing areas of stamp ink, while the surface of the stamp-piece at corresponding sites to non-applied areas of heat-generating material in the manuscript where light passes through and therefore no temperature rise occurs, creates non-fused portions maintaining pores on the surface to be opened outward, forming oozing areas of stamp ink.

The following features are preferable for the second producing process.

A variety of the manuscript using a recording material of a heat-generating material which is elevated in temperature when exposed to light, includes one in which a non-image portion without characters, patterns etc., is formed by the heat-generating material, and one in which an image portion with characters, patterns etc., is formed the heat-generating material. Further, the heat-generating material is preferably ink or toner consisting of carbon or high molecular substances consisting of a heat-fusing material having a higher melting point than a fusing temperature of the stamp-piece.

It should be noted that a sheet and the like as well as a sheet-like material referred in the present invention indicates a film, sheet or plate.

Other than the above, features preferable for the processes of the present invention are as follows:

The stamp-piece made of an elastic resin having open cells therein and capable of absorbing stamp ink is a sponge sheet composed of at least one material selected from the group consisting of natural rubbers, synthetic rubbers and synthetic resins;

the stamp-piece is a sheet of a polyolefin foam of 0.5 to 10 mm thick, having a steric net structure having fine, open cells having an average pore diameter of 2 to 10 μm, a porosity of 30 to 80%, a fusing temperature of 50° to 100° C.; a liquid substance is applied to the manuscript; the liquid substance comprises at least one material selected from the group consisting of water, silicone resins, waxes, mineral oils and vegetable oils; light used is a flashlight containing at least infrared rays emitted from a light source of a xenon flash lamp, a strobe flash or a flash bulb; irradiation of light is effected in a state where the stamp-piece is constricted or pressed; and a difference in level between the non-fused portions and the recessed portions formed by fusing the surface layer of the stamp-piece when light is irradiated in a state where the stamp-piece is constricted, is 0.01 mm or more.

A stamp of the present invention comprises a printing plate obtained by any of the producing processes of the present invention, impregnated with stamp ink.

The stamp-piece used in the producing process of the present invention can be made of any material as long as it is made of an elastic resin, has open cells and is capable of absorbing stamp ink. In particular, the stamp-piece is preferably of an elastic, continuously porous material having a good ink holding ability. Preferable examples are represented by natural rubbers, synthetic rubbers such as a sponge rubber, synthetic resin foams such as of polyethylene, polyurethane etc. As to the shape of the stamp-piece, any features, for example, plate-like, sheet-like, film-like features are acceptable as long as the surface to be formed with a stamping design is flat and smooth. A preferable use is made of a sheet of a polyolefin foam of 0.5 to 10 mm thick, having a steric net structure having fine, open cells having an average pore diameter of 2 to 10 μm, an apparent density of 0.2 to 0.4 g/cm$^3$, a porosity of 30 to 80%, a fusing temperature of 50° to 100° C.

For the illumination of light in the producing process of the present invention, light containing infrared rays is used of a flashlight emitted from a light source such as a xenon flash lamp, a strobe flash, a flash bulb etc.

Upon light-illumination, the stamp-piece to be exposed to the light is pressed to become a thickness of 95 to 30% of the original thickness of the stamp-piece. This presents preferable effects to enhance melting efficiency of the stamp-piece. The stamp-piece is preferably contracted so that a level difference between the oozing areas of stamp ink and the non-oozing areas of stamp ink may be 0.01 mm or more in the resulting printing plate obtained from the plate-making.

The exposure of the stamp-piece to light in its contracted condition does not only melt the surface of the stamp-piece but also fuses the stamp-piece into a predetermined depth in the top layer since pores neighboring in the depth direction are made close to each other. Therefore, it is possible to confine pores in required sites with a less amount of energy. The illuminating energy, of course, depending upon the size of the printing plate, is markedly influenced by the thickness of a manuscript used. That is, the thinner and the higher in transparency that the manuscript is, the less energy that is required. Unless the stamp-piece is pressurized, a large amount of energy is required to completely confine the open cells on the stamp-piece surface, resulting in increased cost of the apparatus. To make matters worse, using a large amount of energy would affect non-fused portions of the stamp-piece (oozing areas of stamp ink), thereby increase the difficulty to manufacture a clear stamp.

A description will now be made on a manuscript used in a first process of producing a printing plate for a stamp of the present invention.

The manuscript defined herein includes characters and/or patterns etc., displayed by applied areas of recording material and non-applied areas of recording material. Examples of the manuscript include one in which an image portion with characters, patterns etc. (impress original image) is represented by applied areas of recording material, one in which an image portion with characters, patterns etc., is represented by non-applied areas of recording material, and a design having light and dark tones is displayed by variations in dot density of the non-applied areas of recording material or the applied areas of recording material. As a manuscript in the present invention, a reference can be made to the applied areas of recording material alone, that is, areas with the non-applied areas of recording material (or the original base portion) cut out.

A specific manuscript is composed of a manuscript sheet such as a sheet of paper, a transparent film, a PPC copy sheet, with an impress original image such as characters, marks, patterns and the like written, drawn, printed, copied, word-processed, typewritten, painted, adhered, laminated or recorded by any other possible method. A manuscript can be represented by a positive or negative image as required.

Any material can be used for the recording material for the recording material applied area, as long as it absorbs or reflects infrared rays. Examples of the materials include pencil traces, ink, toner, ink for markers, ink for ball-point pens, ink for printing, colors, paints, color paper representing character patterns etc., foils of plastics and the like.

The non-applied areas of recording material correspond to the original base or the sheet itself. If an opaque material is used for a manuscript sheet, the material is preferably one which is easy to soak up a liquid substance to be detailed later.

A manuscript having gradations in tone is composed of a manuscript sheet such as paper allowing light such as infrared rays to pass therethrough, a transparent film and the like, with characters, marks, patterns represented with light and dark tones by variations in dot density using a recording material such as ink, toner etc., which absorbs or shields infrared rays. Photographs etc., having gradations are preferably photocopied by the PPC copier to prepare the manuscript to be used for the present invention. Paper, films used as a manuscript sheet preferably have a high transmittance to infrared rays. It is preferable for dots for drawing lines to have higher efficiencies to absorb or shield infrared rays, since, if so, the efficiency of plate-making is improved.

In general, manuscripts prepared by the PPC copier are preferably used as a standard original. That is, since, at present, PPC copiers are widely used in various sites such as convenience stores, offices, schools etc., and general users can use it without fail and since there is no particular difference in infrared-absorbing performances of different kinds of toner, the usability of manuscripts prepared by PPC copiers as a standard original will remarkably improve the general user's convenience of producing a user's original stamp and prevent failures attributed to the recording material used in the manuscript.

As the non-applied areas of recording material on a manuscript constitute corresponding portions to the base material of the manuscript sheet, it is preferable if the portion is as much transparent as possible. When an opaque manuscript sheet such as paper etc. is used, it is preferable to irradiate the manuscript after being soaked in a liquid substance. Soaking the manuscript may be done by applying the liquid substance on both sides of the manuscript. Alternatively, soaking can be effected by applying the liquid substance to the manuscript, before a heat-generating plate is overlaid for the case of a first producing process, or before the stamp-piece is laid over the manuscript for the case of a second producing process. For the liquid substance, any substance which permeates paper, such as silicone oil etc., can be used. Since if dried, the sheet tends to form wrinkles, the liquid substance preferably contains non-volatile components in a high proportion. The liquid substance is one which contains at least one material selected from the group consisting of water, silicone resins, paraffins, mineral oils and vegetable oils. A preferable liquid substance is able to permeate manuscript sheets such as of paper and films, and has non-volatile properties and takes a liquid state at normal temperature and at a heated temperature. The permeation of the liquid substance throughout the manuscript will improve the transmittance of infrared rays and will make the transmittance of infrared rays nearly uniform by absorbing a dispersion of thickness of the manuscript sheet. Accordingly, it is possible to obtain a clear printing plate using a small amount of energy, therefore to improve the efficiency of plate-making.

If no liquid substance is applied, the dispersion of the thickness of the manuscript sheet makes the transmittance of the infrared rays uneven, therefore, it becomes difficult to achieve stabilized plate-making operations. This requires limitations on sheets to be used, degrading the user's convenience.

As a specific example, a manuscript obtained by producing a copy of an image onto a PPC copy sheet in a PPC copier is applied with a liquid substance, whereby the transmittance of the PPC copy sheet to infrared rays can be improved and the dispersion of thickness of the sheet can be absorbed to make the transmittance to infrared rays substantially even throughout the sheet. This effect is not limited to the photocopied manuscript, but a manuscript of similar sheet material with an image written by a writing implement such as a pencil, marker etc., as well as a manuscript outputted from a printer, can gain the similar effect by applying the aforementioned liquid substance to the manuscript.

Now, description will be made on a manuscript used in a second process of producing a printing plate for a stamp of the present invention.

The manuscript defined herein uses as a recording material a heat-generating material that is elevated in temperature when it is exposed to light. Specifically, examples of the manuscript include one in which a heat-generating material consisting of ink or toner containing carbon or high molecular substances is used to form an image portion with characters, patterns etc., and one in which a heat-generating material consisting of ink or toner containing carbon or high molecular substances is used to form a non-image portion without characters, patterns etc. For example, a sheet etc., containing a heat-generating material consisting of ink or toner containing carbon or high molecular substances is cut out to form an image portion with characters, patterns etc., and a non-image portion without characters, patterns etc. This cutting operation can be done by use of a laser. Another example can be mentioned in which a heat-generating material is used as a recording material to form an image portion with characters, patterns etc., or a non-image portion without characters, patterns etc., on an infrared-transmissive sheet etc.

It is necessary for the manuscript used for the second producing process to be formed with a heat-generating material which is elevated in temperature when the recording material on the manuscript is exposed to light. Preferably, the recording material is made of a heat-generating material consisting of ink or toner containing carbon or high molecular substances. More preferably, the ink or toner consisting of carbon or high molecular substances is a heat-fusing substance.

The heat-generating plate used in the process of the present invention contains a heat-generating material which is elevated in temperature when it is exposed to light. Specific examples include a sheet etc., which is composed of a heat-generating material containing carbon or high molecular substances, an infrared-transmissive sheet etc., at least, one side of which is applied with a heat-generating material consisting of ink or toner containing at least one material selected from the group consisting of carbon and high molecular substance, a film, sheet or plate, one side of which is entirely applied with a heat-generating material consisting of a heat-fusing material containing at least one material selected from the group consisting of carbon and high molecular substances. The heat-generating material containing high molecular substances referred to herein can be any material as long as it is elevated in temperature by the illumination of infrared rays and may containing other substances than the high molecular substances. Examples of the high molecular substances include polyolefin resins such as polyethylene etc., acrylate resins, polyamide, polyvinylacetal, polyvinyl alcohol, polyvinyl acetate and the like.

Mentioned as a specific example of the heat-generating plate is a transparent PET film with PPC copier toner composed of carbon, polyethylene resin etc., uniformly affixed over the entire surface thereof.

Mentioned as a heat-generating plate of a heat-generating material arranged like dots (to be referred to as a dotted heat-generating plate) used in the process of the present invention are a film, sheet or plate composed of an infrared-transmissive sheet etc., on which a heat-generating material containing at least one material selected from the group consisting of carbon and high molecular substances is arranged in the form of mesh dots, and a film, sheet or plate composed of an infrared-transmissive sheet etc., on which a heat-generating material consisting of a heat-fusing substance containing at least one material selected from the group consisting of carbon and high molecular substances is arranged in the form of mesh dots.

A specific example of the heat-generating plate is a PET film, acetate film or the like on which toner or ink containing carbon or high molecular substances is arranged in the form of mesh dots. More specifically, PPC copier toner consisting of resins such as polyethylene etc., carbon black and the like is affixed in the form of mesh dots, or ink consisting of carbon black, acrylate resins and the like is printed in the form of mesh dots.

A heat-generating plate may be produced in such a manner, for example, that a heat-generating material consisting of ink or toner consisting of carbon or high molecular substances is gravure-printed or silk-printed in the form of mesh dots on a transparent film.

It is also possible to use a film, sheet or plate on which a heat-fusing material consisting of carbon black, waxes and the like, is modified with a solution of an organic solvent, a resin or etc., into a hot-melt type material, and the thus treated material is applied in the form of mesh dots.

The heat-fusing material used in the producing process of the present invention, contains at least one material selected from the group consisting of carbon and high molecular substances, and has a melting point higher than a fusing temperature of the stamp-piece. Typically, the melting point is about 60° to 150° C.

The heat-fusing material is used in such a manner that the material is dissolved in an organic solvent with a coloring agent and any other filler agents dispersed therein. Alternatively, the heat-fusing material is modified with a resin etc. into a hot-melt type material and the thus modified material (to be referred to as heat-fusing ink) can be used. For example, use is made of a sheet which is formed by applying the heat-fusing ink to a film (to be referred to as heat-fusing ink sheet) having a heat-resistance such as a polyester film. It is possible to obtain a stamp with a printing plate having a colorful printing face by selecting coloring agents for the heat-fusing ink. The melting point of the heat-fusing ink is higher than a fusing temperature of the stamp-piece. The melting point is 60° to 150° C.

BRIEF DESCRIPTION OF THE DRAWINGS

FIG. 1(*a*) shows a stamp-piece S made of polyethylene foam, a heat-generating plate T of carbon film and a manuscript M.

FIG. 1(*b*) shows that the heat-generating plate T is placed over the stamp-piece S, and the manuscript M is further overlaid on the top to form a layered structure.

FIG. 1(*c*) shows light irradiated above the manuscript M; and

FIG. 1(*d*) shows the stamp-piece S completed with plate-making.

FIG. 7(*b*) is an enlarged view of fused portions when a heat-generating plate is used.

Description of reference numerals

Figure 2:
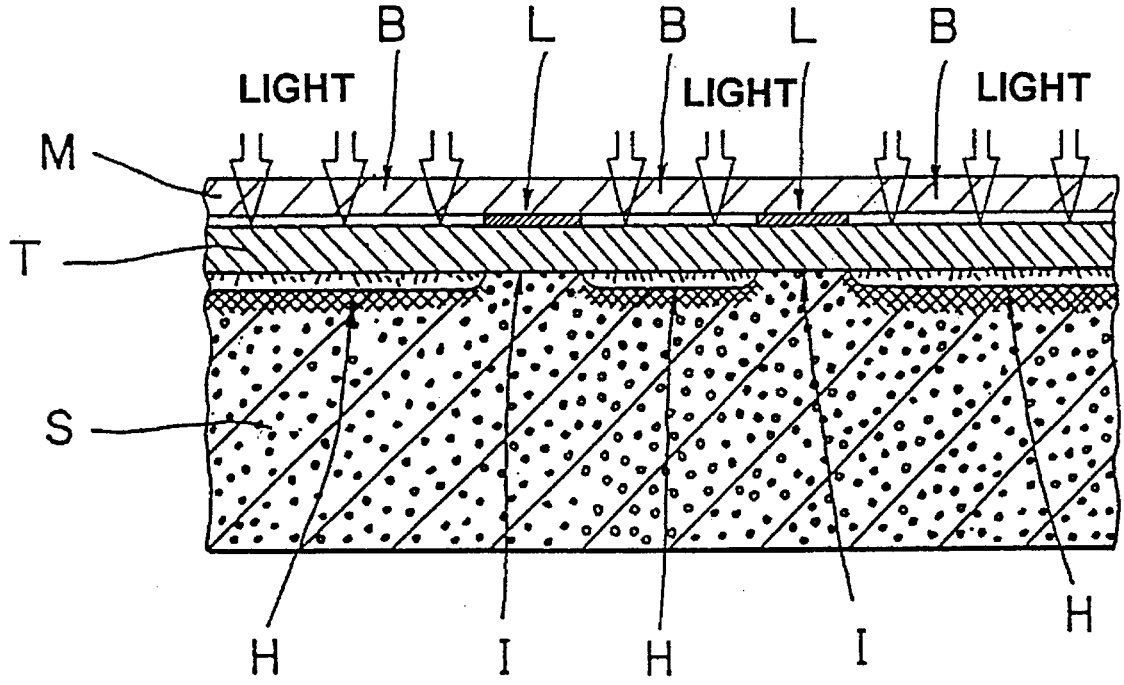
FIG. 2 is a sectional view showing a state of a key step where light is irradiated.

| | |
|---|---|
| S | stamp-piece |
| H | non-oozing area of stamp ink |
| I | oozing area of stamp ink |
| T | heat-generating plate |
| T' | dotted heat-generating plate |
| M | manuscript |
| M3 | manuscript soaked with a liquid substance |
| B | non-image portion without characters, patterns etc. |
| L | image portion with characters, patterns etc. |
| (impress original image) | |
| 1 | flashlight emitting unit |
| 2 | glass plate |
| 4 | heat-fusing ink sheet |
| 5 | heat-fusing ink |
| 5' | heat-generating material |
| 6 | polyester film |
| 6' | acetate film |
| S7 | stamp-piece polyethylene foam sheet |
| 8 | impress original image on a heat-generating manuscript sheet |
| L' | impress original image (black) |
| L" | impress original image (gray) |
| 9 | portion having stamp ink in a dotted pattern |
| 11 | permeated portion of heat-fusing ink |
| 12 | fused portion |
| N | dot-pattern applied portion of carbon or heat-fusing ink |
| MT | heat-generating manuscript sheet |
| f | liquid material permeated portion. |

DETAILED DESCRIPTION OF THE BEST MODE FOR CARRYING OUT THE INVENTION

Explanation will be made referring to examples of the producing process of a printing plate for a stamp of the present invention.

EXAMPLE A

Description will be made on a case of the first producing process of the present invention, where applied areas of recording material constitute an image portion with characters, patterns etc., and the heat-generating plate is a sheet etc., containing carbon or high molecular substances.

A printing face is formed by the steps of: fitting a manuscript over a stamp-piece made of an elastic resin having open cells therein and capable of absorbing stamp ink, with a heat-generating plate interposed between the two which heat-generating plate will be elevated in temperature when it is exposed to light; and irradiating the manuscript with light so as to cause light passing through the non-image portion without characters, patterns etc., in the manuscript to increase the temperature of the heat-generating plate at corresponding sites to the non-image portion without characters, patterns etc., whereby the surface part of the stamp-piece at corresponding sites to the temperature-elevated portions of the heat-generating plate is fused with the heat to confine pores, forming non-oozing areas of stamp ink. On the other hand, light irradiated on the image portion with characters, patterns etc., in the manuscript is blocked to inhibit temperature rise of the heat-generating plate in corresponding places to the image portion with characters, patterns etc., so that open cells are maintained to be open in the corresponding surface part of the stamp-piece to the temperature-rise inhibited portions in the heat-generating plate, forming oozing areas of stamp ink.

As describing with reference to FIG. 1, a manuscript M is fitted over a stamp-piece S made of an elastic resin having open cells therein and capable of absorbing stamp ink, with a heat-generating plate T which will be elevated in temperature when it is exposed to light, and the heat-generating plate T interposed between the two. The manuscript M is exposed to light, so that light passing through the non-image portion B without characters, patterns etc., in the manuscript M increases the temperature of the heat-generating plate T at corresponding sites to the non-image portion B without characters, patterns etc. The heat-generating plate T in turn heats and fuses the surface part of the stamp-piece S at corresponding sites to the temperature-elevated portions of the heat-generating plate T, to thereby confine pores and form fused portions, providing non-oozing areas H of stamp ink. On the other hand, as light is blocked by the image portion L with characters, patterns etc., in the manuscript M, temperature rise of the heat-generating plate T is inhibited in corresponding places to the image portion L with characters, patterns etc. Therefore, open cells in the surface part of the stamp-piece S are maintained to be opened outward in the non-fused portions corresponding to the non-temperature-rise portions in the heat-generating plate T, whereby oozing areas I of stamp ink are formed.

EXAMPLE B

Description will be made on a case of the first producing process of the present invention, where applied areas of recording material constitute an image portion with characters, patterns etc., and used as the heat-generating plate is a heat-fusing ink sheet.

A printing face is formed by the steps of: fitting a heat-fusing ink sheet over a stamp-piece with its heat-fusing ink face in contact with the surface of the stamp-piece made of an elastic resin having open cells therein and capable of absorbing stamp ink; placing a desired manuscript over the top in such a manner that the impress original image may appear to be a mirror image; and exposing the stamp-piece from above the manuscript to light containing infrared rays, whereby fused portions and non-fused portions of the heat-fusing ink are formed on the surface of the stamp-piece. In the fused portion, a heat-fusing ink permeates pores of the stamp-piece and the heat from the heat-fusing ink seals and confines the pores in the surface layer of the stamp-piece, so that the fused portions form non-oozing portions of stamp ink and the non-fused portion form oozing portions of stamp ink to complete a printing face.

For forming the printing face on the stamp-piece surface, the heat-fusing ink sheet is fitted over the stamp-piece with its heat-fusing ink face in contact with the surface of the stamp-piece. Then, the manuscript is laid over the top in such a manner that the impress original image may appear to be a mirror image. As the manuscript is exposed from thereabove to a flashlight containing infrared rays, other areas than the impress original image in the manuscript allow infrared rays to transmit and reach the heat-fusing ink sheet, whereby the heat-fusing ink is fused. As the melted heat-fusing ink permeates the surface of the sponge stamp-piece or pores of the stamp-piece, the heat from the heat-fusing ink seals and confines the pores in the surface layer of the stamp-piece, forming portions which do not allow stamp ink occluded by the stamp-piece to flow out.

On the other hand, since infrared rays do not pass through the impress original image portion in the manuscript, the heat-fusing ink on the heat-using ink sheet is not affected. Therefore, ink will neither permeate nor fuse the stamp-piece. The non-fused areas constitute portions allowing ink occluded by the stamp-piece to ooze out. Thus, the printing face is formed by the combination of the fused areas and non-fused areas, and gives the desired impression when it is impressed.

EXAMPLE C

Description will be made on a case of the first producing process of the present invention, where a liquid substance is made to permeate the manuscript in Example A.

A heat-generating plate composed of at least one material selected from the group consisting of carbon and high molecular substances is fitted over the surface of a stamp-piece made of an elastic resin having open cells therein and capable of absorbing stamp ink. A desired manuscript made of a liquid-absorptive opaque sheet is soaked with a liquid substance and the thus soaked manuscript is laid over the top in such a manner that the impress original image may appear to be a mirror image. Then, the stamp-piece is exposed from the manuscript side to a flashlight containing infrared rays. By this exposition, corresponding portions of the heat-generating plate to other areas than the impress original image are heated to thereby fuse the stamp-piece surface, forming non-oozing portions of stamp ink. On the other hand, the stamp surface portions corresponding to the impress original image do not fuse, whereby oozing portions of stamp ink are created.

EXAMPLE D

Description will be made on a case of the first producing process of the present invention, where a liquid substance is made to permeate the manuscript in Example B.

A heat-fusing ink sheet is fitted over a stamp-piece with its heat-fusing ink face in contact with the surface of the stamp-piece made of an elastic resin having open cells therein and capable of absorbing stamp ink. A manuscript made of a liquid-absorptive opaque sheet is soaked with a liquid substance and the thus soaked manuscript is laid over the top in such a manner that the impress original image may appear to be a mirror image. Then, the stamp-piece is exposed from the manuscript side to a flashlight containing infrared rays. By this exposition, heat-fusing ink in the corresponding portions of the heat-fusing ink sheet to other areas than the impress original image, permeates pores of the stamp-piece while the heat from the heat-fusing ink seals and confines the pores in the surface layer of the stamp-piece, forming non-oozing portions of stamp ink. On the other hand, in the stamp surface portions corresponding to the impress original image, no heat-fusing ink fuses, whereby oozing portions of stamp ink are created.

Now, description will be made as to the formation of the printing face on the stamp-piece surface. When the surface of the stamp-piece is processed by overlaying the heat-fusing ink sheet on the surface of the stamp-piece so that the heat-fusing ink face may come in contact with the stamp-piece surface; placing a manuscript applied with liquid silicone or the like over the heat-fusing ink sheet so that the impress original image may be mirrored; and irradiating the stamp-piece with a flashlight containing infrared rays from the top, areas in the manuscript other than the impress original image allow infrared rays to transmit to the heat-fusing ink sheet so that carbon and/or high molecular substances contained in the ink of the heat-fusing ink sheet are heated in the areas. The thus heated material permeates pores in the stamp-piece while the heat from the ink seals and confines the pores in the surface layer of the stamp-piece, forming non-oozing portions of stamp ink which do not allow stamp ink occluded inside the sponge stamp-piece to flow out. On the other hand, since the impress original image portion in the manuscript does not allow infrared rays to reach the heat-fusing ink sheet, any ink of the heat-fusing ink sheet will not either heat or fuse. Therefore, no change occurs on the stamp-piece surface, whereby ink-oozing portions of stamp ink occluded in the stamp-piece are formed. These fused or permeated portions and the non-fused or non-permeated portions in combination constitute the printing face, which gives the desired impression when the stamp is pressed.

EXAMPLE E

Description will be made on a case of the first producing process of the present invention, where a manuscript with light and dark tones represented by variations in dot density is used together with a heat-generating plate having heat-generating material arranged in a dotted pattern.

A printing face with gradations is formed by the steps of: fitting a dotted heat-generating plate on which at least one material selected from the group consisting of carbon and high molecular substances is arranged in a dotted pattern, over a stamp-piece, having open cells therein and capable of absorbing stamp ink; placing a manuscript with light and dark tones represented by variations in dot density over the top in such a manner that the impress original image may appear to be a mirror image; and exposing the stamp-piece from the manuscript side to a flashlight containing infrared rays, whereby only the part on the stamp-piece surface corresponding to the portions other than dots on the manuscript and the dots on the dotted heat-generated plate is fused to form non-oozing portions of stamp ink while corresponding surface parts of stamp-piece to the dotted portions in the manuscript and the portions other than the dots on the dotted heat-generated plate, the dotted portions in the manuscript and the dots on the dotted heat-generated plate, and the portions other than dots on the manuscript and the portions other than the dots on the dotted heat-generated plate remain unmelted, forming oozing portions of stamp ink. For forming the printing face on the stamp-piece surface, the dotted heat-generating plate is fitted over the stamp-piece with its ink face in contact with the surface of the stamp-piece. Then, the manuscript having light and dark tones represented by variations in dot density, only after the manuscript is applied with a liquid such as silicone etc., to be improved in transmitting efficiency for infrared rays if it is of a thick sheet of paper such as a PPC copy sheet, is laid over the top in such a manner that the impress original image in the manuscript may appear to be a mirror image. As the manuscript is exposed from thereabove to a flashlight containing infrared rays, other areas than dots on the manuscript allow infrared rays to transmit and reach the dotted heat-generating plate, whereby carbon and/or high molecular substances contained in the ink or toner applied dot-wise on the dotted heat-generating plate are made to generate heat, which in turn fuses the surface of the stamp-piece. When a heat-generating plate with heat-fusing ink applied thereon in a dotted pattern is used, both the effect for fusing the surface of the stamp-piece and the permeation of the heat-fusing ink promote the stamp-piece surface to confine, forming portions which do not allow stamp ink occluded by the stamp-piece to flow out.

On the other hand, infrared rays are hard to reach the heat-generating plate in the dotted part of the manuscript, since infrared rays are reflected or absorbed by dots of toner or ink etc., which constitute a design of the impression manuscript. Therefore, carbon and/or high molecular substances contained in ink or toner applied on the heat-generating plate do not generate heat or, granting that it generates heat, the heat is trivial. As a result, no change does occur on the stamp-piece surface, whereby oozing portions of stamp ink occluded in the stamp-piece are formed. The printing face is formed by variations in density of dots formed by the fused portions and the non-fused portions and gives an impression representing desired light and dark tones when the stamp is impressed.

For example, using a manuscript produced by copying a photograph etc., having light and dark tones in a PPC copier capable of reproducing black and white-tone gradations together with a dotted heat-generating plate composed of a PET film with toner or ink applied thereon in a dotted pattern, irradiated infrared rays are made to pass through other part than dotted portions in the manuscript so as to cause dotted toner or ink on the heat-generating plate to generate heat, whereby open cells on the surface of a stamp-piece are selectively confined thus forming a printing surface (effecting plate-making).

Since a dark tone portion (to be called a black solid portion) in the manuscript shields the flashlight, the corresponding dots on the heat-generating plate to the black solid portion are not excited to heat by infrared rays. Therefore, these dots do not affect the stamp-piece surface, so that the portion remains unmelted forming an oozing portion of stamp ink.

Since a white solid portion in the manuscript allows the entire flashlight to reach the heat-generating plate, all the dots in question on the heat-generating plate generate heat. Although other areas than the dots do not heat, the heat from each dot mutually influences that of others in connection with irradiating energy, whereby open cells on the surface of the stamp-piece are confined continuously or thoroughly, forming a fused portion which in turn becomes a non-oozing portion of stamp ink.

A halftone portion in the manuscript is represented by variations in dot size or dot density. The flashlight is blocked by dotted portions but it reaches the heat-generating plate other than the dotted portions. And yet, the flashlight does not reach the entire part of the dots of the heat-generating plate, unlike the case of a white solid pattern. That is, a less amount of infrared rays passes through so that only some part of dots can be excited to heat. Therefore, the dots on the heat-generating plate tend to little influence each other, so that the heated pattern takes on a dotted form. As a result, non-fused portions similar to the dot distribution on the manuscript pattern on the stamp piece surface are formed to become an oozing portion of stamp ink. The dot density on the surface of the stamp-piece could be reduced as compared to the that of the manuscript, yet, halftone patterns can be realized.

The manuscript used in the above producing method can be obtained by reproducing a proper image of a photograph etc., having gradations in a PPC copier. Since the heat-generating material on the dotted heat-generating plate is arranged in a dotted pattern, there is no need for setting a dot screen over an original when it is duplicated, or for dot-separation printing. Accordingly, no time and labor are required for producing a manuscript.

Description will be made with reference to FIG. 9.

Patterns, photographs etc., duplicated by a PPC copier capable of representing gradations, reproduce light and dark tones varying dot density. If, with such a manuscript as it is, a heat-generating plate (solid heat-generating plate) having a heat-generating material on the whole surface is used, the resolution of the plate is as fairly low as 50 to 150 dpi. as compared to that of a PPC copier. Therefore, if such a manuscript is made into a plate using the solid heat-generating plate, a halftone portion having a high dot density tends to be reproduced as a black pattern while another halftone portion having a low dot density tends to be reproduced as a white pattern. In one word, it is difficult to produce a stamp which is able to reproduce an impression having gradations [see FIG. 9(B)].

For the betterment of the situation, there is a method which facilitates the gradations to be reproduced by roughening the dot density. That is, a 50 to 100-line dot screen formed of a transparent film with identically sized white dots arranged in a regulated manner is laid over a photograph etc., as stated, and this lamination is duplicated in a PPC copier to produce a manuscript having light and dark tones reproduced by large and small dots. When the thus prepared manuscript, as placed over a solid heat-generating plate on a stamp-piece in a pressurized state, is exposed to a flashlight, it is possible to effect plate-making of a stamp-printing face having a dotted pattern [see FIG. 9(C)].

This plate-making of a stamp, however, has some drawbacks as follows: it is difficult to obtain a clear, dark impression since even a black solid part contains white dots; a dot-screen which is most suited to a pattern used must be selected in order to obtain a stamp having a good reproduction performance; and extra time and labor are required such as for use of a dot-screen when it is duplicated. Further skills are needed for optimizing the reproduction density.

Figure 9:
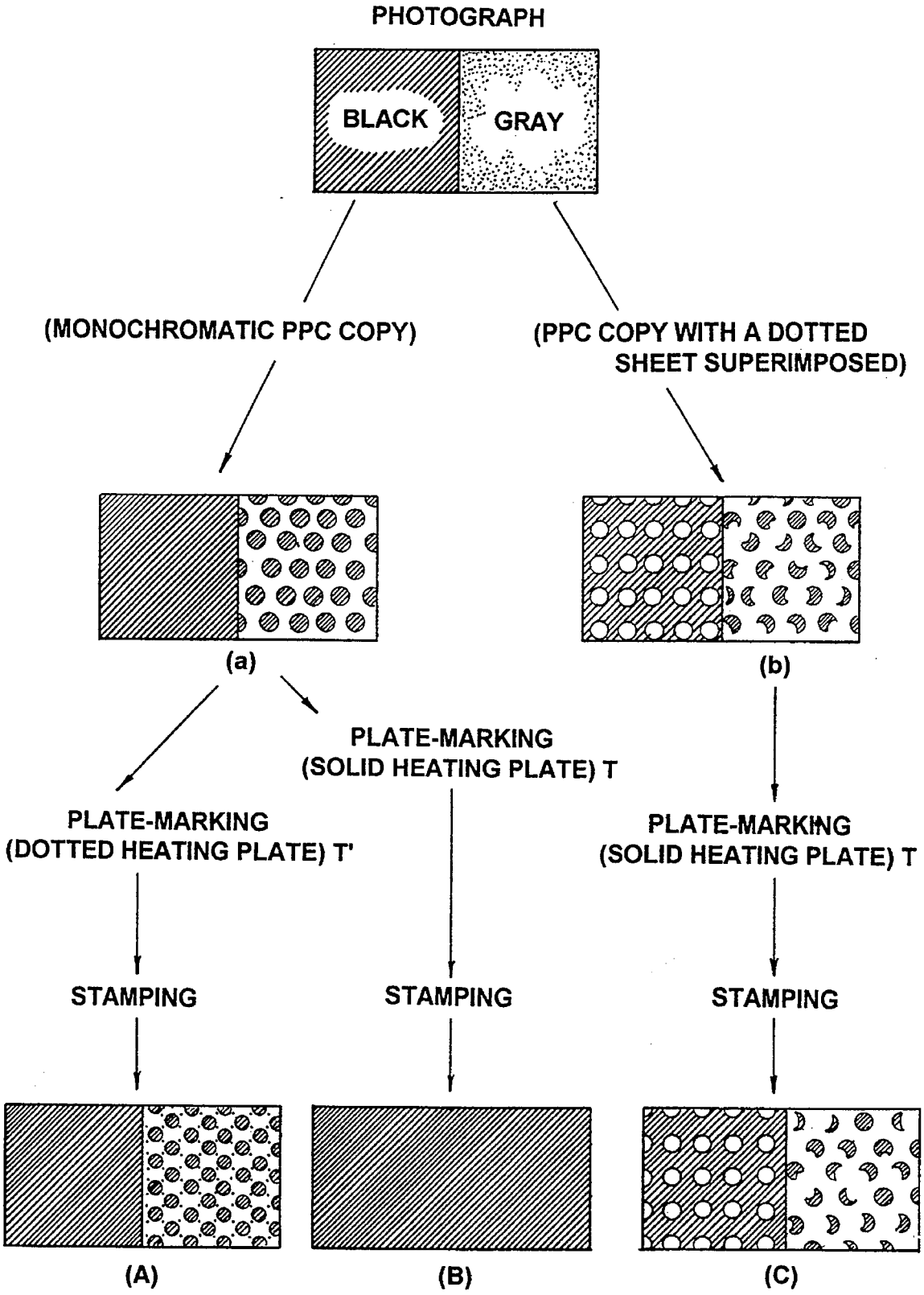
FIGS. 9(*a*)–(*c*) are an illustration showing compared cases of a dotted heat-generation plate, a normal heat-generating plate and a dotted sheet (with a normal heat-generating plate).

In contrast to this, since the method of the present invention uses a heat-generating plate with a heat-generating material arranged in a dotted pattern, a black solid portion in a manuscript, unlike in the manuscript produced by duplicating an original superposed with a dot-screen [FIG. 9(*b*)], is reproduced in plate-making as a black solid pattern since no infrared rays pass through the black solid portion, whereby no confinement of open cells on the surface of the stamp-printing face occurs and therefore it is possible to reproduce a black solid portion in the impression and to obtain a dark impress image.

On the other hand, when the number of lines and density of dots on the heat-generating plate are optimally set up, generated heat from all the dots corresponding to a white solid portion may mutually affect one another, and therefore it becomes possible to cause thorough confinement of open cells on the surface of the sponge stamp-piece, thus forming a white solid pattern in its impression. For even a low density portion in the impress original, if it is represented by a certain range of dots having more than a certain dot size, each dot will not be affected by the heat from its peripheral part, so that it is possible to leave minute non-fused portions and therefore to reproduce small dots in the manuscript. Further, it is easier to make uniform the number of lines and density of dots on the heat-generating plate in the printing stage etc., than to control the density of a duplicating manuscript by the user. Therefore, unsatisfactory stamps markedly reduce in number.

Since the reproducible range of light and dark tones of the impression can be enlarged from the reasons described above, it is possible to produce a relatively clear printing plate for a stamp, even if the permissible range of the density of the manuscript duplicated is enlarged.

EXAMPLE F.

Description will be made on a case of the second producing process of the present invention, where applied areas of recording material in a manuscript constitute a non-image portion without characters, patterns etc., [for instance, a transparent sheet etc., on which a black-and-white reversal, normal image (the base of the sheet etc., forms a normal image) is drawn, with a heat-generating material as a writing material (to be referred to hereinafter as a heat-generating manuscript sheet).]

A printing face is formed by the steps of: fitting a heat-generating manuscript sheet having a desired impress image depicted thereon over a stamp-piece with its heat-generating material face in contact with the surface of a stamp-piece made of an elastic resin having open cells therein and capable of absorbing stamp ink; and exposing the heat-generating manuscript sheet from thereabove to light containing infrared rays, whereby fused portions and non-fused portions are formed on the surface of the stamp-piece, so that the fused portions form non-oozing portions of stamp ink and the non-fused portion form oozing portions of stamp ink to complete a printing face.

For forming the printing face on the stamp-piece surface in this producing process, the heat-generating manuscript sheet having a black-and-white reversal image of a desired impress image depicted thereon is fitted over the stamp-piece with its heat-generating material face in contact with the surface of the stamp-piece. Then, the manuscript sheet is exposed from thereabove to a flashlight containing infrared rays. Other areas than the impress image in the heat-generating manuscript sheet (that is, portions in which the recording material to be excited to heat by light exists) directly absorb infrared rays, whereby the generated heat from the recording material on the heat-generating manuscript sheet fuses the surface of the stamp-piece. In the fused portions, pores on the surface of the stamp-piece are confined to form portions which do not allow stamp ink occluded by the stamp-piece to flow out.

On the other hand, the areas of impress-mirrored image on the manuscript sheet (that is, the areas without recording material) allow infrared rays to just pass through directly, so that no fusion in the stamp-piece does occur. The non-fused areas constitute portions allowing ink occluded by the stamp-piece to ooze out. Thus, the printing face is formed by the combination of the fused areas and non-fused areas, and gives the desired impression when it is impressed.

The heat-generating sheet used in this example can easily be obtained by printing a black-and-white reversal, normal image on a transparent sheet using a laser printer.

EXAMPLE G.

Description will be made on a case of the second process of producing a printing plate for a stamp in accordance with the present invention, where recording material applied areas constitute an image portion without characters, patterns etc.

A printing face is formed by the steps of: fitting a manuscript over a stamp-piece, having open cells therein and capable of absorbing stamp ink; and irradiating the manuscript with light so as to increase the temperature of an image portion (areas with a heat-generating material) with characters, patterns etc., whereby the surface part of the stamp-piece at corresponding sites to the temperature-elevated areas is fused with the heat and changed into fused portions that confine pores, forming non-oozing areas of stamp ink. On the other hand, a non-image portion (areas without a heat-generating material) without characters, patterns etc., in the manuscript allows light to pass through, so that no temperature rise does occur, whereby the corresponding surface part of the stamp-piece to the areas forms non-fused portions which maintain the open cells to be opened outward, forming oozing areas of stamp ink.

This example coincides with the producing process shown in ex.A, except in that the heat-generating member is disused. Although a positive printing face is formed in the producing process of ex.A, a negative printing face is created in this producing process.

Thus, in the producing process examples shown in Examples A through G, when the stamp-piece is contracted by about 5 to 70% at the time of the exposition to flashlight so that pores inside the stamp-piece is elastically deformed to make the neighboring pores close to each other, the surface layer of the stamp-piece can be fused in a concave state up to a constant depth by the heat at the time of heating. When the stamp-piece is contracted so that the resulting stamp face may have a difference in level of 0.01 mm or more between the fused portion and the non-fused portion or the non-oozing area of stamp ink and the oozing area of the stamp ink, good confinement of open cells can be realized, that is, the sealing of ink can be done well whereby it is possible to obtain a good impress image.

A further merit given by the provision of the difference in level is that dirt on the printing face can be cleaned when stamp ink is refilled. Alternatively, this makes it difficult for stamp ink to permeate non-oozing portions at the time of impressing, so that a clear impress image can readily be obtained.

A stamp of the present invention indicates a printing plate thus obtained for use as it is or a product in which the thus obtained printing plate, attached to a mount is impregnated with stamp ink.

The printing plate for a stamp obtained in the producing process of the present invention, has a merit that the surface of the printing plate itself is subjected to plate-making to form a stamping face so that it functions as a stamp individually without being assembled with another part. Yet, if the printing plate is attached to a mount, it is possible to form a typical stamp. Upon use, if the sponge stamp piece is made to be impregnated with ink or to absorb ink in advance, it is possible to repeatedly obtain clear impress images without supplying ink for a long time. Ink to be occluded in the stamp presents preferable impressing performances if the ink has a viscosity of 100 to 500 mPa·s and is unvolatile at normal temperature. Needless to say, ink to be used should not be limited to those specified herein.

If a stamp ink absorptive material having a higher porosity than the sponge stamp-piece for printing plates is interposed between the printing plate and the mount, it is possible to lengthen the duration allowing continuous impressing as well as to make it easy to supply stamp ink.

If the printing plate for a stamp of the present invention is attached to the surface of a roll so as to be rotated with the roll, it is possible to realize continuous printing.

EXAMPLES

Examples of the present invention will be described.

Example 1

Description is made with reference to FIGS.1 and 2. As shown in FIG. 1(*a*), a stamp-piece S made of polyethylene foam, a heat-generating plate T of a carbon film and a manuscript M are provided. At first, as shown in (*b*), the heat-generating plate T is placed over the stamp-piece S. The manuscript M is further overlaid on the top to form a layered structure. Here, the manuscript M is placed with its printed face of characters, patterns etc., in contact with the heat-generating plate T. Next, as shown in (c), light is irradiated above the manuscript M. A xenon lamp and the like can be used as a light source. Irradiation of light is preferably done with flashlight. Upon the irradiation, as shown in FIG. 2, light is shielded by image areas L with characters, patterns etc. in the manuscript M or even if it generates some heat, the heat is too weak to fuse the stamp-piece through the heat-generating plate. Light transmits through non-image areas B without characters, patterns etc., to reach the heat-generating plate T. Sites on the heat-generating plate T where light hits it are elevated in temperature while other part than the sites does not vary in temperature. Surface areas on the stamp-piece S in contact with the temperature rise portions of heat generating plate T are fused by the heat to confine pores and become constricted to form slightly depressed states. These portions become non-oozing portion H of ink shown in FIG. 1(*d*). Surface areas on the stamp-piece S in contact with the non-rise portions of temperature in heat generating plate T maintain the open cells to be opened. These portions become oozing portion I of ink shown in FIG. 1(*d*). Plate-making is thus completed. The stamp-piece S, after the manuscript M and the heat-generating plate T are removed therefrom, is made to absorb ink, whereby it can be used as a stamp for impressing.

Example 2

When the heat-generating plate T is interposed between the manuscript M and the stamp-piece S as in Example 1, a positive printing face relative to the manuscript M is created. In a case where a heat-generating material is used as the recording material, if the heat-generating plate T is disused, a negative printing face is created. In this case, light passing through non-image areas B without characters, patterns etc., directly hits the stamp-piece S causing no change while toner etc. of a photocopied manuscript in the image portion L with characters, patterns etc., on the manuscript M absorbs light and is elevated in temperature, whereby the corresponding surface of the stamp-piece S to those areas is fused. This is why a negative printing face is formed.

Example 3

Preparation of a manuscript:

A printed material was duplicated by a PPC copier to create a manuscript M having an impress original image L.

Preparation of a printing plate:

The manuscript M is placed on a transparent glass plate 2 of a light emitting device 1 which emits flashlight containing infrared rays in such a position that the impress original image L may appear to be a normal image. Laid over the manuscript M is a heat-fusing ink sheet 4 with its heat-fusing ink 5 side up. Overlaid on the top is a stamp-piece S7 made of polyethylene foam sheet having a steric net structure with extra-fine, open cells having an average pore size of 3 μm and a porosity of 60% [see FIG. 3(*a*)].

Figure 3A:
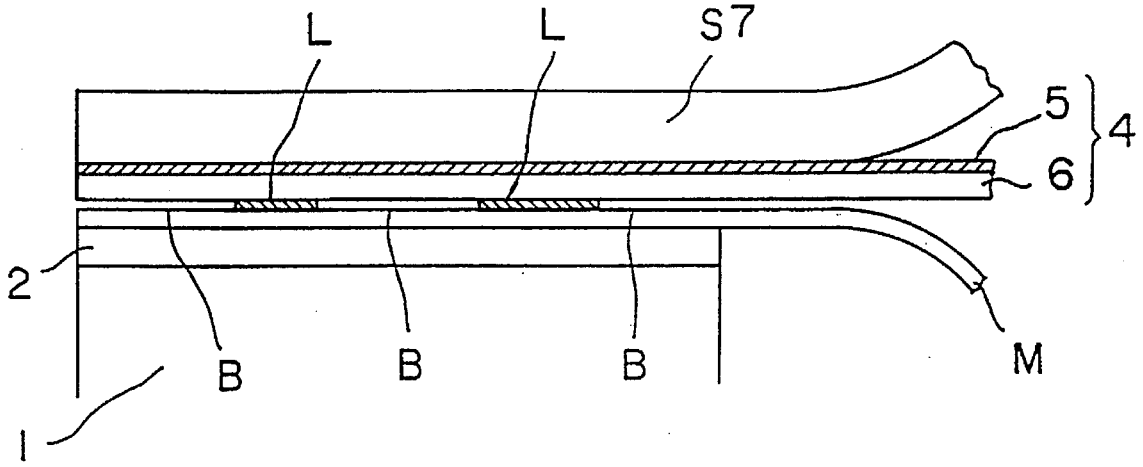
FIG. 3 shows schematic views of production of a printing plate for a stamp (using a manuscript and a heat-fusing ink sheet), that is, FIGS.3(*a*) and 3(*b*) are schematic views showing respective heat-fusing states of a stamp piece caused by the heat-fusing ink and permeation of the ink, before and after the irradiation.
Figure 3B:
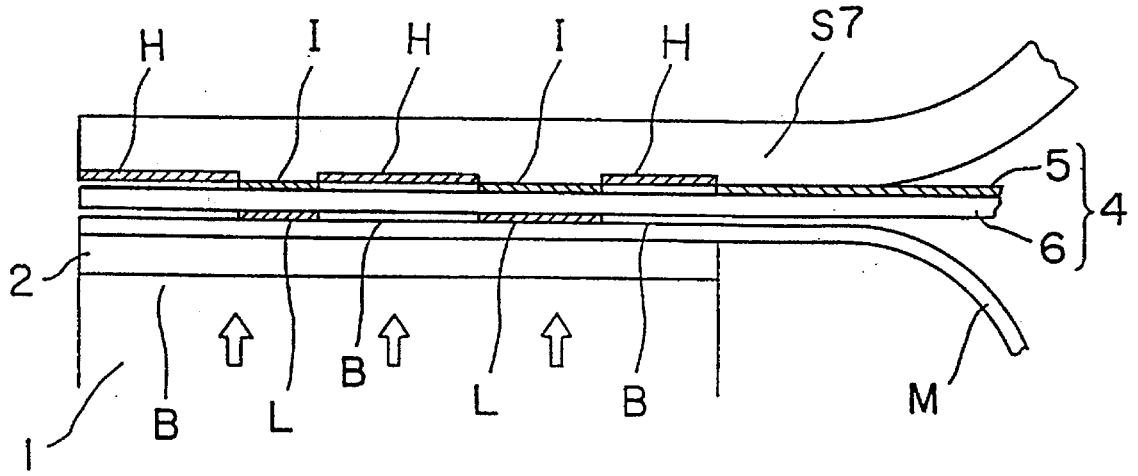

This stamp-piece was pressurized so that the stamp-piece was elastically deformed in the thickness direction by about 50%, and was irradiated with a flashlight in this pressurized state. As shown in FIG. 3(*b*), the impress original image L in the manuscript M blocks light so that corresponding places on the heat-fusing ink sheet 4 to the impress original image portion is inhibited to be elevated in temperature, whereby no ink-fusion occurs in the corresponding portions on the polyethylene foam sheet S7. Accordingly, oozing portions I of stamp ink is formed and left as a mirrored image in the portions. In the other part of the surface, the heat-fusing ink 5 permeates the pores in the stamp-piece, and the heat from the ink closely confines the pores in the topmost layer of the stamp-piece, so that fused portions 12 and heat-fusing ink permeated portions 11, as coexisting, constitute non-oozing portions H of stamp ink. The thus obtained printing plate for a stamp had a difference in level of 0.3 mm between the non-oozing portion H of stamp ink and the oozing portion I of stamp ink on the printing face [see FIG. 7(*a*)].

This printing plate was attached to a mount. The printing plate, as made to absorb stamp ink, was used to stamp successively. A very clear impress was obtained.

Example 4

Preparation of a heat-generating manuscript sheet:

A black-and-white reversal normal image was printed on a sheet allowing infrared rays to pass therethrough using a laser printer in which a heat-generating material composed of toner that is excited to heat by infrared rays was used as a recording material. Thus, a heat-generating manuscript sheet MT was obtained which had an impress original 8 formed of desired characters displayed by non-applied portions of recording material on the printing face of the sheet.

Preparation of a printing plate:

The heat-generating manuscript sheet MT is placed on a transparent glass 2 of a light emitting device 1 which emits flashlight containing infrared rays in such a manner that the side of its heat-generating material 5' may be up. Overlaid on the top is a stamp-piece S7 made of polyethylene sheet foam having a steric net structure with extra-fine, open cells having an apparent density of 0.3 g/cm$^3$ [see FIG. 4(*a*)].

Figure 4A:
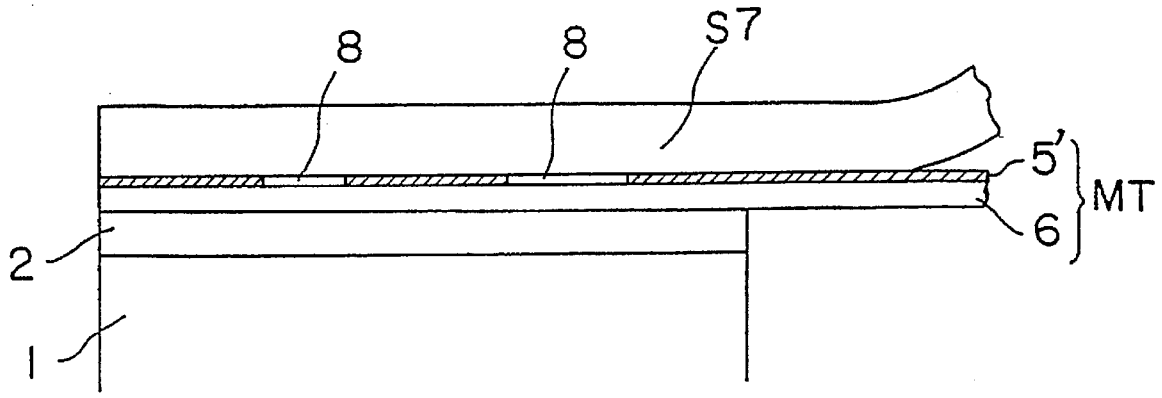
FIG. 4 shows schematic views of production of a printing plate for a stamp (using a heat-generating manuscript sheet), that is, FIGS.4(*a*) and 4(*b*) are schematic views showing respective heat-fusing states of the surface layer of a stamp piece, before and after the irradiation.
Figure 4B:
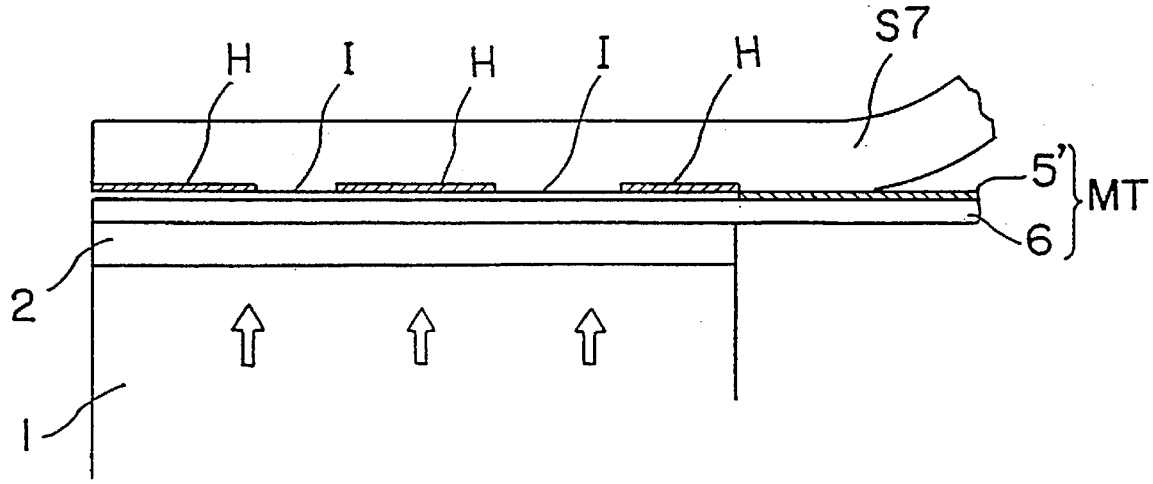

This stamp-piece was pressurized so that the stamp-piece was elastically deformed in the thickness direction by about 5 to 50%, and was irradiated with a flashlight in this pressurized state. As shown in FIG. 4(*b*), as the portion of the impress original image 8 on the heat-generating manuscript sheet MT allows light to pass therethrough, the corresponding portion on the surface of the stamp-piece S7 is unchanged, forming oozing portions I of stamp ink, left as a mirrored image. In the other part of the surface, the recording material generates heat and contacts and fuses the surface of the stamp-piece to confine the pores in the topmost layer thereof, forming non-oozing portions H of stamp ink. The thus obtained printing plate for a stamp had a difference in level of 0.5 mm between the non-oozing portion H and the oozing portion I of stamp ink on the printing face [see FIG. 7(*a*)].

The level difference could be secured greater than that in the case of Example 1, because of the lack of the manuscript.

Example 5

Preparation of a manuscript:

A manuscript M3 having an impress original image L was prepared in a PPC copier using a 64 kg/cm$^3$ PPC copy sheet.

Preparation of a printing plate:

The manuscript M3 is placed on a transparent glass plate 2 of a xenon flashlight emitting device 1 having a light-emitting energy of 50 joules in such a manner that the impress original image L may appear to be a normal image. Then, a liquid silicone ["KF96" a product of Shin-Etsu Chemical Co., Ltd.] was applied on the manuscript. Laid over the manuscript M3 is a heat-fusing ink sheet 4 (the melting point of the heat-fusing ink: 70° C.) with its heat-fusing ink 5 side up. Overlaid on the top is a stamp-piece S7 made of polyethylene foam sheet (30 mm square of 4 mm thick) having a steric net structure with extra-fine, open cells having an average pore size of 3μm and a porosity of 60% [see FIG. 5].

Figure 5:
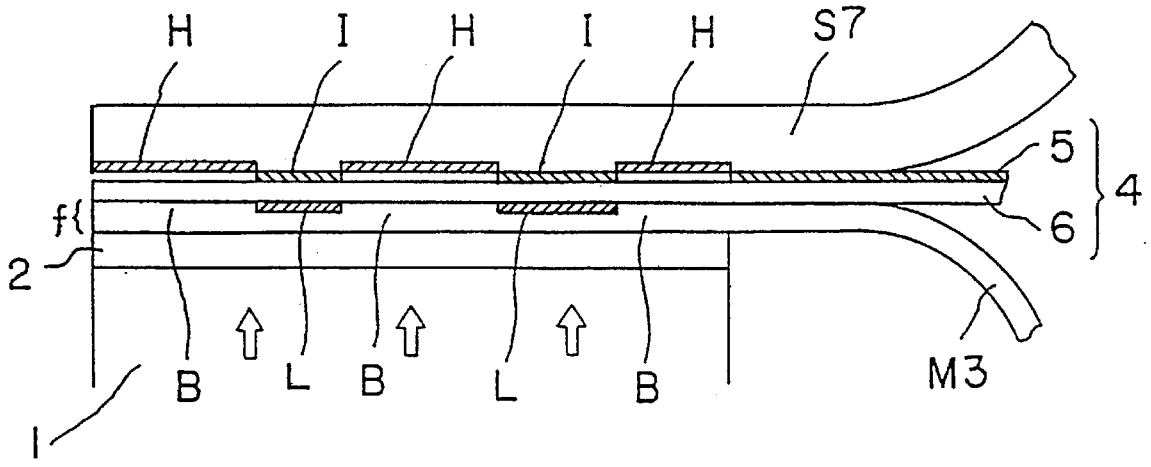
FIG. 5 is a schematic view showing a production of a printing plate for a stamp when a heat-fusing ink is used as a heat-generating plate together with a manuscript applied with a liquid substance.

This stamp-piece was pressurized so that the stamp-piece was elastically deformed in the thickness direction by about 50%, and was irradiated with a flashlight in this pressurized state. As shown in FIG. 5, a thin film of the liquid silicone was formed between the manuscript M3 and the heat-fusing ink sheet 4 and the liquid silicone permeated (f) the manuscript M3. On the surface of the stamp-piece S7, the corresponding portion to the impress original image L in the manuscript M3 becomes oozing portions I of stamp ink and is left as a mirrored image. In the other part of the surface of the stamp-piece S7, the heat-fusing ink, as it fuses, permeates the pores in the stamp-piece, and the heat from the ink closely confines the pores in the topmost layer of the stamp-piece, so that fused portions 12 and heat-fusing ink permeated portions 11, as coexisting, constitute non-oozing portions H of stamp ink. In order to obtain a level difference between the oozing portion I and the non-oozing portion H of stamp ink, energy of 50 joules was required.

In contrast, energy of 100 joules was required to obtain a level difference in Example 3.

Example 6

Figure 6:
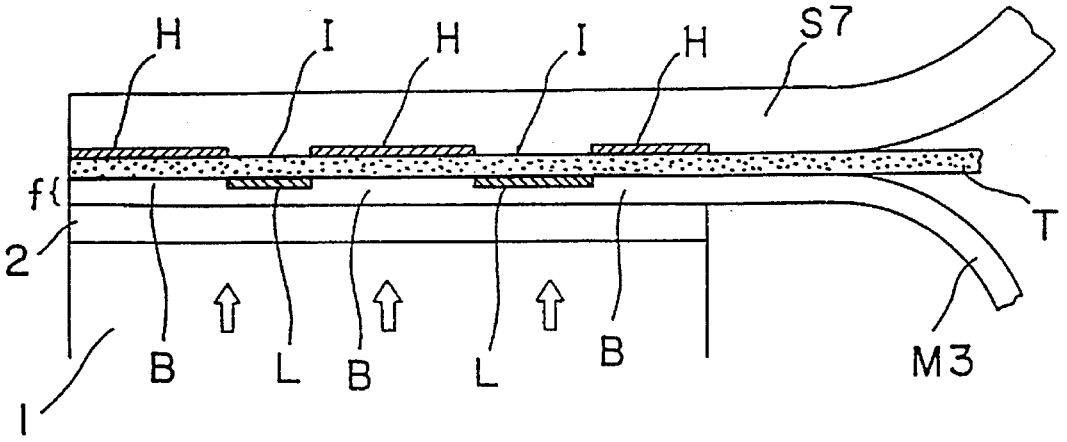
FIG. 6 is a schematic view showing a production of a printing plate for a stamp when a heat-generating plate is used together with a manuscript applied with a liquid substance.

The same operation as in Example 5 was effected except in that the heat-fusing ink sheet 4 was replaced with a heat-generating plate T. As shown in FIG. 6, on the surface of the stamp-piece S7, the corresponding portion to the impress original image L in the manuscript M3 is left as oozing portions I (mirrored image) of stamp ink while non-oozing portions H of stamp ink are formed in the other part of the surface.

Currently sold PPC copy sheets for monochromatic copiers generally have a meter-square weight of 52 kg to 64 kg/m$^2$. If a liquid substance is applied on the manuscript as in Examples 5 and 6, it is possible to obtain a printing face having almost the same level difference for a different sheet belonging to the above range, in the aforementioned plate-making condition.

In the case where no liquid substance is used, if a manuscript of 52 kg/m$^2$ is used in a plate-making apparatus in which the flashlight condition is set up for a manuscript of 64 kg/m$^2$, the impress original image L cannot sufficiently block the flashlight. Accordingly, the portions of the stamp-piece which should constitute non-fused portions in a proper condition might partially be fused, making it impossible to obtain a good printing face. To deal with this, a filter etc., need be interposed for damping the energy to effect the plate-making, resulting in inconvenienced handling. The introduction of the liquid substance makes it possible to provide regular printing faces even for different kinds of the manuscript sheets having different thickness.

Example 7

A photograph was copied in a monochromatic PPC copier to prepare a manuscript M3 having impress original images L' (black) and L" (gray).

Preparation of a dotted heat-generating plate T':

A dotted pattern of dots with 0.14 mm in diameter and a dot pitch of 0.2 mm was printed on an acetate film 6' of 0.05 mm thick using a laser printer with toner N consisting of polystyrene resin, carbon black etc.

Preparation of a printing plate:

The manuscript M3 is placed on a transparent glass plate 2 of a xenon flashlight emitting device 1 having a light-emitting energy of 50 joules in such a manner that the impress original images L' (black) and L" (gray) may appear to be a normal image. Laid over the manuscript M3 is the dotted heat-generating plate T' with its ink or toner face N up. Overlaid on the top is a stamp-piece S7 made of polyethylene foam sheet having a steric net structure with extra-fine, open cells of a porosity of 50% (apparent density of 0.3g/cm$^3$)[see FIG. 8(*a*)].

Figure 8A:
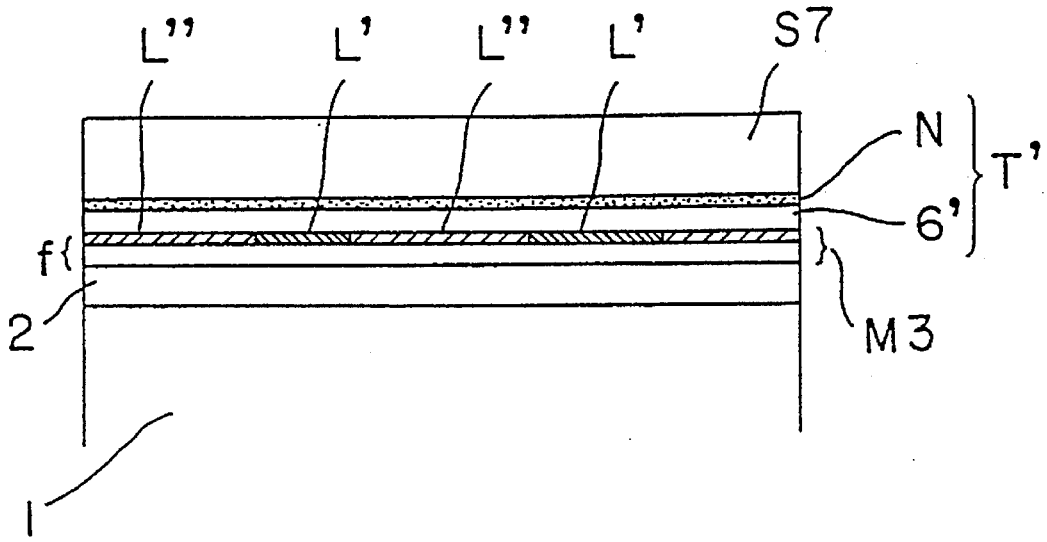
FIGS. 8(*a*) and 8(*b*) show schematic views showing, before and after irradiation, a production of a printing plate for a stamp when a dotted heat-generating plate are used with a manuscript having light and dark tones.
Figure 8B:
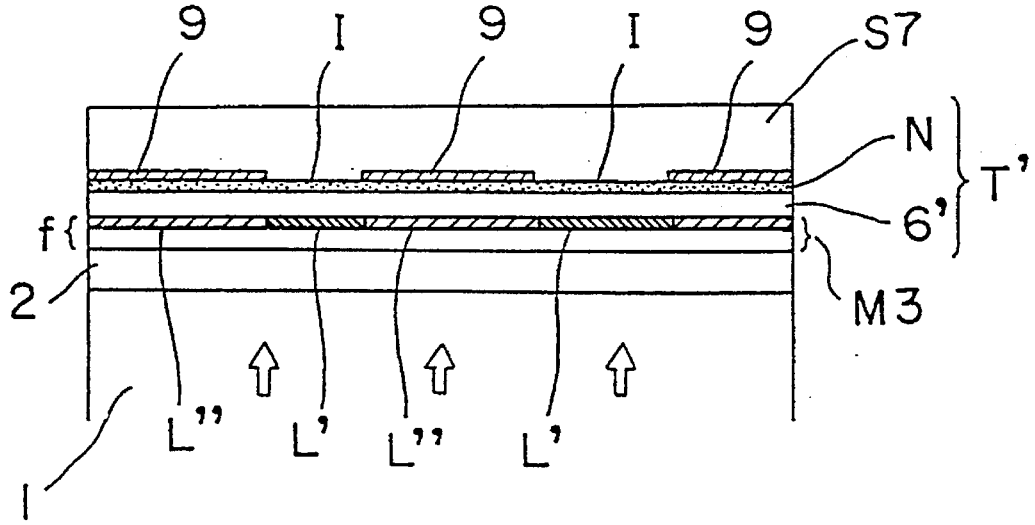

This stamp-piece S7 was pressurized so that the stamp-piece was elastically deformed in the thickness direction by about 5 to 50%, and was irradiated with a flashlight in this pressurized state. As shown in FIG. 8(*b*), obtained on the surface of the stamp-piece S7 is a printing face having an impress original mirrored image composed of oozing portions I of stamp ink and portions 9 including dotted stamp ink oozing areas.

Specifically, as shown in FIG. 9, when a photograph (black and gray) is copied by a monochromatic PPC copier, a manuscript M3 having a state shown in FIG. 9(*a*) is obtained. As the manuscript overlaid by the dotted heat-generating plate T' is irradiated with a flashlight, the black portion does not excite the heat-generating plate, the corresponding portion of the stamp-piece S7 becomes a non-fused portion forming an ink-oozing portion I, which presents a black solid portion at the time of stamping. On the other hand, only the intersections of white or void portions in the gray areas (the areas corresponding to L" in FIG. 8) and dots on the dotted heat-generating plate form fused portions (the non-oozing portions of stamp ink) on the stamp-piece surface, which in turn present white void at the time of stamping. That is, an impress having a feature shown in (A) is reproduced in which a black pattern similar to that in the manuscript and a gray pattern darker in some degree than that in the manuscript are reproduced.

Example 8

The same operation as in Example 7 was effected except in that dots for preparing a dotted heat-generating plate were formed with heat-fusing ink.

Figure 7A:
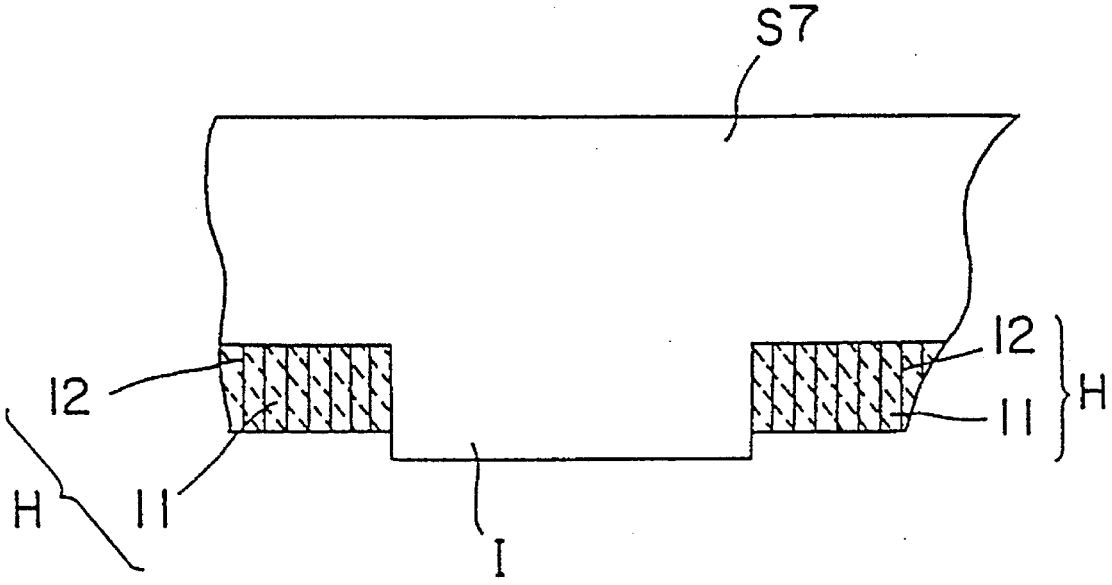
FIG. 7(*a*) is an enlarged view of fusing and permeating portions (in which fused portions 12 and permeated portions 11 exist together) when a heat-fusing ink sheet is used.
Figure 7B:
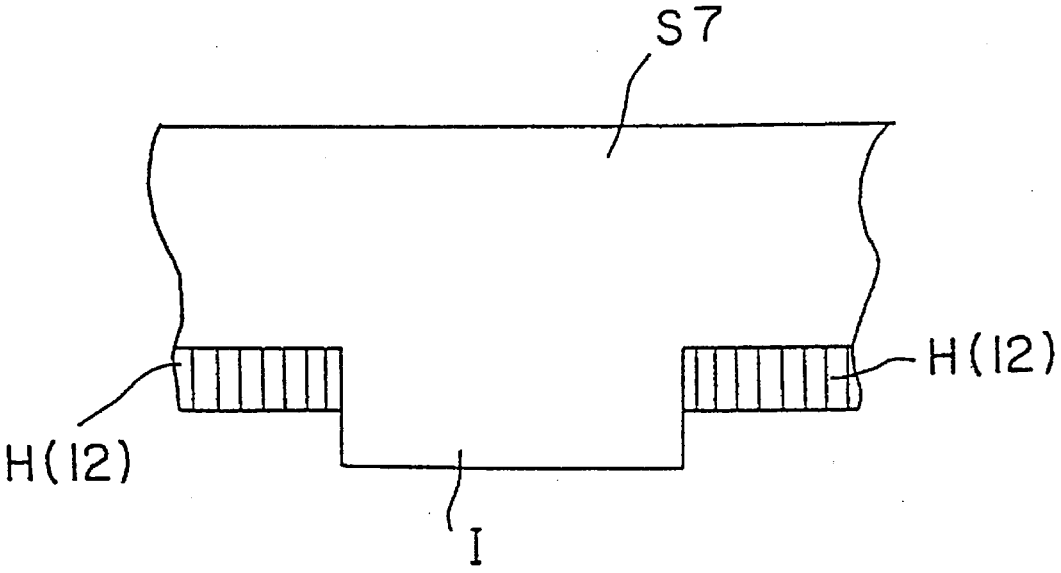

As oozing portions I of stamp ink and non-oozing portions H on the stamp-piece are shown on an enlarged scale as in FIG. 7(*a*). In contrast, the case of Example 7 is shown in FIG. 7(*b*).

Comparative Example 1

The same operation as in Example 1 was effected expect in that the dotted heat-generating plate was replaced with a heat-generating plate without dots. As stamped, the impress image presented a nearly black solid pattern (FIG. 9(B)).

Comparative Example 2

The photograph (black and gray) overlaid with a dotted sheet was copied in a PPC photo copier to produce a manuscript shown in FIG. 9(*b*). The manuscript was used to perform the similar operation to that in Comparative Example 1. As stamped, an impress image (C) was obtained which as a whole was lowered in density and deficient in clearness.

Since plate-making of a printing face can be done as the manners illustrated in Examples 7 and 8, a manuscript can be prepared from a photograph or pattern having light and dark tones by using a PPC copier, without necessity of using the dot separation technique with dotted screens. In the thus obtained impress image, black solid portions in the original can be reproduced as black solid patterns by forming thoroughly oozing portions of ink.

In the case where an original overlaid with a dot screen is copied to produce a manuscript, a black solid portion cannot be reproduced as a black solid pattern since there appear white void portions. As compared to this case, an impress image having increased density can be obtained.

Since halftoned portions are constituted by distributed dots in the manuscript, only the intersections of other portions than dots in the manuscript and dots on the dotted heat-generating plate generate heat to fuse the corresponding portions in the topmost layer of the stamp-piece, so that the open cells in the corresponding portions are confined forming non-oozing portions. As a result of the plate-making, halftone portions in the manuscript are reproduced by higher density dot patterns on the resulting printing face. Nevertheless, since the density of the impressed image is increased as a whole, it is possible to provide sufficient reproducing performances for human's sense of sight.

In white solid portions such as in a background and the like, all the open cells in the surface layers of the stamp-piece should be thoroughly confined, but, since the heating part of the heat-generating plate is arranged in a dotted pattern, inter-dot portions tend not to be fused enough and therefore could form ink oozing portions. Nevertheless, by properly determining the dot size and dot pitch of the dots on the heat-generating plate, it is possible to make dots interact to thereby realize complete confinement of pores in large white solid portions.

This means that, by adjusting the heat-generating material on the heat-generating plate with a particular pattern, it is possible to plate-make a printing face having a different pattern without effecting special treatment on the manuscript.

INDUSTRIAL APPLICABILITY

Since the stamp-piece is made of a resin having open cells and it therefore can absorb a certain quantity of ink, the stamp-piece has an advantage of freedom from troublesome handling of applying ink to the printing face for every stamping action. Since the surface of the stamp-piece itself is subjected to plate-making to form a printing face which is individually functional, the stamp-piece has an advantage that there is no need for assembling it with other parts and therefore the production is easy. Since the plate-making of the stamp-piece is done with only heat treatment without necessity of applying photosensitive agent etc., rinsing or the like, the stamp-piece has a further advantage that it is possible to omit complicated producing steps.

Since the producing process of a printing plate for a stamp of the present invention comprises simple steps and does not need any metal die and the like, it is possible to instantly provide a high-quality stamp fitting for a particular purpose. Since it is possible to directly create a positive printing face from a positive, copy manuscript if a heat-generating plate is used, it is possible to avoid effecting the conventional complicated procedure of plate-making in which a manuscript is used to form a stencil for plate-making, which in turn is used to prepare a metal die to thereby form a positive printing face. Needless to say, the situation is the same for a negative manuscript.

Particularly, in the present invention, since confinement of pores of the stamp-piece is effected by flashlight irradiation in a condition where the stamp-piece is contracted, it is possible to fuse neighboring pores in the surface layer of the stamp-piece in a closely constricted state. Accordingly, the process can be effected completely with relatively low energy, little affecting non-fused portions, so that it is possible to produce a printing plate with high quality. Further, since non-image areas, as formed by recessed portions, are not impregnated with ink, it is possible to obtain a good impress image. Moreover, since in the present invention, transmittance of infrared rays through a manuscript is enhanced by applying a liquid substance such as a liquid silicone etc., to the manuscript, it is possible to realize confinement of open cells in the stamp-piece surface with relatively low energy.

It is possible to provide a stamp which is capable of repeatedly stamping an impress image having gradations without supplying ink by merely photocopying a photograph or a design having light and dark tones in a PPC copier to thereby make a dot-pattern plate of a manuscript, without necessity of any special treatment upon the preparation of the manuscript. Since no white void portion is generated in black solid portions, black solid portions in the impress image appear darkly and therefore it is possible to obtain an impress image having a wide variations of light and dark tones. As a result, it is possible to obtain a highly reproductive impress image if the permissible range of density variations of a copy original is enlarged.

The printing plate for a stamp obtained in the producing process of the present invention has an advantage that the surface itself is formed into a printing face to function as a stamp without being assembled with other parts. When the printing plate of the present invention is used as a typical stamp attached to a mount, the stamp has an advantage of freedom from troublesome handling of applying ink to the printing face for every stamping action, since the printing plate is formed of a stamp-piece having open cells and capable of absorbing ink. The printing plate of the present invention is characterized by the fact that a high-quality, clear impress image can be obtained at stamping.

We claim:

1. A process for producing a printing plate for a stamp comprising the steps of:

fitting a manuscript having characters, patterns and the like displayed by applied areas of recording material and non-applied areas of recording material, over a stamp-piece made of an elastic resin having open cells therein and capable of absorbing stamp ink, with a heat-generating plate containing a heat-generating material which will be elevated in temperature when exposed to light, interposed between said manuscript and said stamp-piece;

irradiating the manuscript with light so as to cause light passing through said non-applied areas of recording material to increase the temperature of the heat-generating material at corresponding sites to the non-applied areas of recording material whereby the surface part of a stamp-piece at corresponding sites to the temperature-elevated portions of the heat-generating material is fused with the heat to confine pores, forming non-oozing areas of stamp ink; and causing said applied areas of recording material to block light so as to inhibit temperature rise of the heat-generating material in corresponding places to said applied areas of recording material, whereby open cells are maintained to be open in the corresponding surface part of said stamp-piece to a temperature-rise inhibited portions in the heat-generating material, forming oozing areas of stamp ink.

2. A process for producing a printing plate for a stamp according to claim 1 wherein said stamp-piece made of an elastic resin having open cells therein and capable of absorbing stamp ink is a sponge sheet composed of at least one material selected from the group consisting of natural rubbers, synthetic rubbers and synthetic resins.

3. A process for producing a printing plate for a stamp according to claim 1 wherein said stamp-piece made of an elastic resin having open cells therein and capable of absorbing stamp ink is a sheet of a polyolefin foam of 0.5 to 10 mm thick, having a steric net structure having fine, open cells having an average pore diameter of 2 to 10 μm, a porosity of 30 to 80%, a fusing temperature of 50° to 100° C.

4. A process for producing a printing plate for a stamp according to claim 1 wherein said heat-generating plate containing a heat-generating material which will be elevated in temperature when exposed to light is a sheet containing a heat-generating material containing carbon or high molecular substances.

5. A process for producing a printing plate for a stamp according to claim 1 wherein said heat-generating plate containing a heat-generating material which will be elevated in temperature when exposed to light is a sheet-like material comprising: a sheet allowing infrared rays to pass therethrough; and a heat-generating material consisting of ink or toner containing at least one material selected from the group consisting of carbon and high molecular substances, applied on at least one side of said sheet.

6. A process for producing a printing plate for a stamp according to claim 1 wherein said heat-generating plate containing a heat-generating material which will be elevated in temperature when exposed to light is a sheet-like material comprising: a sheet allowing infrared rays to pass therethrough; and a heat-generating material consisting of a heat-fusing material having a higher melting point than a fusing temperature of said stamp-piece and containing at least one material selected from the group consisting of carbon and high molecular substances, applied on one side of said sheet.

7. A process for producing a printing plate for a stamp according to claim 1 wherein said heat-generating plate containing a heat-generating material which will be elevated in temperature when exposed to light is a sheet-like material comprising: a sheet allowing infrared rays to pass therethrough; and a heat-generating material containing at least one material selected from the group consisting of carbon and high molecular substances, applied in a dotted pattern on said sheet while said manuscript having characters, patterns displayed by applied areas of recording material and non-applied areas of recording material, comprises a design having light and dark tones displayed by variations in dot density.

8. A process for producing a printing plate for a stamp according to claim 1 wherein said heat-generating plate containing a heat-generating material which will be elevated in temperature when exposed to light is a sheet-like material comprising: a sheet allowing infrared rays to pass therethrough; and a heat-generating material consisting of a heat-fusing material having a higher melting point than a fusing temperature of said stamp-piece and containing at least one material selected from the group consisting of carbon and high molecular substances, applied in a dotted pattern on said sheet while said manuscript having characters, patterns displayed by applied areas of recording material and non-applied areas of recording material, comprises a design having light and dark tones displayed by variations in dot density.

9. A process for producing a printing plate for a stamp according to claim 1, wherein at least one liquid substance selected from the group consisting of water, silicone resins, waxes, mineral oils and vegetable oils is applied to said manuscript having characters or patterns displayed by applied areas of recording material and non-applied areas of recording material.

10. A process for producing a printing plate for a stamp according to claim 1 wherein light used is a flashlight containing at least infrared rays emitted from a light source of a xenon flash lamp, a strobe flash or a flash bulb.

11. A process for producing a printing plate for a stamp according to claim 1, wherein irradiation of light is effected in a state where said stamp-piece is pressed to a thickness of 95 to 30% of the original thickness of the stamp-piece.

12. A process for producing a printing plate for a stamp according to claim 11 wherein said stamp-piece is pressed so that a level difference between said oozing areas of stamp ink and said non-oozing areas of stamp ink becomes 0.01 mm or more.

13. A process for producing a printing plate for a stamp comprising the steps of:

fitting a manuscript using a recording material of a heat-generating material which will be elevated in temperature when exposed to light, over a stamp-piece made of an elastic resin having open cells therein and capable of absorbing stamp ink, irradiating the manuscript with light so as to increase the temperature of applied areas of heat-generating material whereby the surface of the stamp-piece at corresponding sites to the temperature-elevated areas of the heat-generating material is fused with the heat to create fused portions confining pores, forming non-oozing areas of stamp ink, while the surface of the stamp-piece at corresponding sites to non-applied areas of heat-generating material in the manuscript where light passes through and therefore no temperature rise occurs, creates non-fused portions maintaining pores on the surface to be opened outward, forming oozing areas of stamp ink.

14. A process for producing a printing plate for a stamp according to claim 13 wherein said manuscript using a recording material of a heat-generating material which will be elevated in temperature when exposed to light uses ink or toner containing carbon or high molecular substances as the heat-generating material, and the heat-generating material constitutes image portions with characters, patterns etc.

15. A process for producing a printing plate for a stamp according to claim 13 wherein said manuscript using a recording material of a heat-generating material which will be elevated in temperature when exposed to light uses ink or toner containing carbon or high molecular substances as the heat-generating material, and the heat-generating material constitutes non-image portions without characters, patterns etc.

16. A process for producing a printing plate for a stamp according to claim 13, wherein said heat-generating material is comprised of a heat-fusing material having a higher melting point than a fusing temperature of said stamp-piece.

17. A process for producing a printing plate for a stamp according to claim 13 wherein said stamp-piece made of an elastic resin having open cells therein and capable of absorbing stamp ink is a sponge sheet composed of at least one material selected from the group consisting of natural rubbers, synthetic rubbers and synthetic resins.

18. A process for producing a printing plate for a stamp according to claim 13 wherein said stamp-piece made of an elastic resin having open cells therein and capable of absorbing stamp ink is a sheet of a polyolefin foam of 0.5 to 10 mm thick, having a steric net structure having fine, open cells having an average pore diameter of 2 to 10 μm, a porosity of 30 to 80%, a fusing temperature of 50° to 100° C.

19. A process for producing a printing plate for a stamp according to claim 13, wherein at least one liquid substance selected from the group consisting of water, silicone resins, waxes, mineral oils and vegetable oils is applied to said manuscript using a recording material of a heat-generating material which will be elevated in temperature when exposed to light.

20. A process for producing a printing plate for a stamp according to claim 13 wherein light used is a flashlight containing at least infrared rays emitted from a light source of a xenon flash lamp, a strobe flash or a flash bulb.

21. A process for producing a printing plate for a stamp according to claim 13, wherein irradiation of light is effected in a state where said stamp-piece is pressed to a thickness of 95 to 30% of the original thickness of the stamp-piece.

22. A process for producing a printing plate for a stamp according to claim 21 wherein said stamp-piece is pressed so that a level difference between said oozing area of stamp ink and said non-oozing areas of stamp ink becomes 0.01 mm or more.

* * * * *